US005236339A

United States Patent [19]

Nishiumi et al.

[11] Patent Number: 5,236,339

[45] Date of Patent: Aug. 17, 1993

[54] COIN SELECTOR

[75] Inventors: Kenji Nishiumi, Sakado; Kenji Nakajima, Saitama; Mitsugu Mikami, Kawagoe, Sakado, all of Japan

[73] Assignee: Kabushiki Kaisha Nippon Conlux, Tokyo, Japan

[21] Appl. No.: 741,912

[22] Filed: Aug. 8, 1991

[30] Foreign Application Priority Data

Aug. 14, 1990 [JP] Japan ..... 2-85762[U]
Aug. 14, 1990 [JP] Japan ..... 2-85763[U]
Apr. 5, 1991 [JP] Japan ..... 3-73276

[51] Int. Cl.[5] ..... G07D 3/00

[52] U.S. Cl. ..... 194/343; 271/273; 453/56; 194/318; 194/203; 194/348

[58] Field of Search ..... 194/317, 206, 207, 203, 194/343, 318; 453/56; 271/273, 274; 198/626.2-626.4

[56] References Cited

U.S. PATENT DOCUMENTS 2,995,976 8/1961 Weingart .
3,347,249 10/1967 Becker .
3,621,854 11/1971 Redman .
3,667,485 6/1972 Sesko .
3,939,954 2/1976 Collins .
4,017,169 4/1977 Komura et al. ..... 271/273 X
4,318,484 3/1982 Stiernspetz .
4,441,516 4/1984 Stadler et al. ..... 453/56 X
4,558,711 12/1985 Yoshiaki et al. .
4,570,923 2/1986 Hooper et al. ..... 271/273 X
4,850,468 7/1989 Kobayashi et al. .
4,850,469 7/1989 Hayashi et al. .

FOREIGN PATENT DOCUMENTS 2263973 10/1974 Fed. Rep. of Germany .
3022794 3/1981 Fed. Rep. of Germany .
2634301 1/1990 France .
62-245495 10/1987 Japan .
62-266692 11/1987 Japan .

*Primary Examiner*—Michael S. Huppert
*Assistant Examiner*—William M. Hienz

[57] ABSTRACT

A coin selector includes a horizontal coin conveying unit for forcibly conveying a coin inserted through a coin insert slit in the horizontal direction while the coin is held between an opposing pair of endless belts. The horizontal coin conveying unit is slidably arranged in a housing of the coin selector, and moreover, the space defined by the opposing pair of endless belts is enlarged by turnably opening the opposing pair of endless belt about their one end. The upstream side of the horizontal coin conveying unit is covered with a cover, and a liquid collecting portion is attached to the cover so as to allow a liquid received through the coin insert slit to be quickly discharged outside of the coin selector.

13 Claims, 14 Drawing Sheets

COIN SELECTOR

BACKGROUND OF THE INVENTION

1. Field of the Invention

The present invention relates generally to a coin selector installed in a so-called coin treatment apparatus employable for an automatic vending machine, a coin exchanger, a monetary service unit or the like wherein a coin inserted through a coin insert slit is selectively received and stored depending on the kind of coins and some of the coins which have been selectively received and stored in that way are paid out as a change. More particularly, the present invention relates to a coin selector including a coin selecting section for discriminating whether a coin inserted through the coin insert slit is a true coin or a false coin and then selectively distributing true coin depending on the kind of true coins.

2. Description of the Related Art

To facilitate understanding of the present invention, a typical conventional coin selector will briefly be described below with reference to FIG. 13.

Generally, a conventional coin selector 3 installed in a coin treatment apparatus employable for an automatic vending machine, a coin exchanger, a monetary service unit or the like is constructed as schematically illustrated in FIG. 13, i.e., a sectional view of the coin selector 3.

As shown in FIG. 13, to practically use the coin selector 3 installed in an equipment such as an automatic vending machine or the like, a long coin intake chute 5 is slantwise arranged between a coin insert slit 2 fitted to a door 1 of the equipment and a coin inlet port 4 of the coin selector 3 in such a manner that the upstream end 5*a* of the coin intake chute 5 is exposed to the coin insert slit 2 and the downstream end 5*b* of the same is exposed to the coin inlet port 4 of the coin selector 3. With such arrangement of the coin intake chute 5 as described above, when a coin A is inserted into the coin insert slit 2, it is delivered to the coin inlet port 4 of the coin selector 3 at an accelerated speed induced during free-falling of the inserted coin A through the coin intake chute 5 due to its dead weight.

With the conventional coin selector 3 as described above, since the long coin intake chute 5 should slantwise be arranged between the coin insert slit 2 and the coin inlet port 4, a space S occupied in the equipment in the vertical direction for installing the coin selector 3 is enlarged unavoidably. For this reason, especially with respect to an automatic vending machine, there arises another problem that a space required for receiving commercial articles to be sold is restricted or reduced undesirably.

To obviate the foregoing problems, a proposal has been made as to a coin selector constructed in the following manner. In detail, horizontal coin conveying means for forcibly conveying each coin inserted through the coin insert slit 2 in a housing of the proposed coin selector is substituted for the long coin intake chute 5, whereby a space required for installing the coin selector in the equipment such as an automatic vending machine or the like is reduced remarkably.

FIG. 14 is a sectional view which schematically illustrates the structure of a conventional prior art coin selector 10 of the foregoing type including horizontal coin conveying means and installed in an equipment such as an automatic vending machine or the like. As is apparent from the drawing, a space S' occupied in the equipment in the vertical direction for installing the coin selector 10 is substantially equalized to a height H' of the coin selector 10 as measured in the vertical direction. This means that the space reserved exclusively for the coin selector 10 to be installed in the equipment is very small, and moreover, the coin selector 10 itself is constructed in a very compact manner.

The coin selector 10 includes a housing 11 having a substantially inverted L-shaped configuration as seen from the side, and the left-hand end of the housing 11 is secured to a door 1 for the equipment such as an automatic vending machine or the like. A coin insert slit 22 is formed on the door 1.

As shown in FIG. 15, i.e., an enlarged sectional view of FIG. 14, horizontal coin conveying means 24 for forcibly conveying a coin inserted through the coin insert slit 22 in the horizontal direction (in the rightward direction as seen in the drawing) while holding the coin A between a pair of endless belts 27 and 29 as well as a single inclined coin rolling-down passage 25 including coin distributing means (not shown) for selectively distributing coins conveyed from the horizontal coin conveying means 24 depending on the kind of coins are properly arranged in the housing 11 of the coin selector 10.

With the horizontal coin conveying means 24 as described above, when the upper endless belt 27 extending around a group of rollers 26*a*, 26*b*, 26*c* and 26*d* and the lower endless belt 29 extending around a group of rollers 28*a*, 28*b*, 28*c*, 28*d* and 28*e* are recirculatively driven by driving means such an motor or the like (not shown), the coin A inserted through the coin insert slit 22 is forcibly conveyed in the horizontal direction (in the rightward direction in the drawing) while it is held between the pair of endless belts 27 and 29.

Coin discriminating means 32 including a so-called coil sensor composed of an oscillating coil 30 and a signal receiving coil 31 with a predetermined gap therebetween is arranged at an intermediate position of the horizontal coin conveying means 24. The coin discriminating means 32 discriminates whether the coin A which has been forcibly conveyed by the horizontal coin conveying means 24 while it is held between the pair of endless belts 27 and 29 is a true coin or a false coin. In addition, the coin discriminating means 32 discriminates the kind of coins each recognized as a true coin.

In FIG. 15, reference numeral 58 designates a coin distributing lever adapted to be actuated in response to a detection signal transmitted from the coin discriminating means 32. When the coin A conveyed from the horizontal coin conveying means 24 is discriminated as a false coin in response to the detection signal transmitted from the coin discriminating means 32, the coin distributing lever 58 is held at the waiting position represented by solid lines in the drawing. At this time, the false coin A conveyed from the horizontal coin conveying means 24 is conducted to a false coin chute 59 and it is then delivered to a coin pay-out port (not shown). On the contrary, when the coin A conveyed from the horizontal coin conveying means 24 is discriminated as a true coin in response to the detection signal transmitted from the coin discriminating means 32, the coin distributing lever 58 is turnably displaced to the position represented by one-dot chain lines in the drawing. At this time, the true coin A is selectively distributed to the inclined coin rolling-down passage 25 including coin distributing means (not shown) for selectively distributing the true coin A depending on the kind of each true coin.

With respect to the conventional coin selector 10 including the horizontal coin conveying means 24 in the above-described manner, since a group of rollers composed of plural opposing pairs of rollers and a pair of endless belts 27 and 29 constituting the horizontal coin conveying means 24 are immovably arranged in the housing 11 of the coin selector 10, when an inspecting-/maintaining operation is performed for the horizontal coin conveying means 24 or a cleaning operation is performed for a group of rollers 26*a*, 26*b*, 26*c*, 26*d*, 28*a*, 28*b*, 28*c*, 28*d* and 28*e* as well as the endless belts 27 and 29 extending around the foregoing rollers, a time-consuming operation, i.e., an operation for disassembling the housing 11 of the coin selector 10 should be performed unavoidably. However, there arises a problem that the foregoing operation is very complicated.

In addition, with respect to the conventional coin selector 10 including the horizontal coin conveying means 24 in the above-described manner, since the upstream side of the horizontal coin conveying means 24 is covered with a cover 90 in which the coin insert slit 22 is received, when water drops derived from rain fall or a viscous liquid such as a detergent solution or the like are introduced through the coin insert slit 22, the liquid flows in the housing 11 of the coin selector 10 along the bottom 90*a* of the cover 90 in the allow-marked direction as seen in FIG. 15. Once the viscous liquid such as a detergent solution or the like is received in the housing 11, it adheres to a driving unit such as a solenoid (not shown) for actuating the coin distributing lever 58. For this reason, there is a possibility that the driving unit is incorrectly operated whereby a selecting function of the coin selector 10 is degraded. Another problem is that there is a possibility that operation of each coin selecting component is undesirably locked when the viscous liquid adhering to the respective coin selecting components is dried with the result that a function of the coin selector 10 itself is interrupted.

SUMMARY OF THE INVENTION

The present invention has been made with the foregoing background in mind.

A primary object of the present invention is to provide a coin selector which assures that an inspecting-/maintaining operation can easily be performed for horizontal coin conveying means.

A secondary object of the present invention is to provide a coin selector which assures that a liquid received through a coin insert slit is not introduced into a housing of the coin selector without fail.

To accomplish the primary object, there is provided according to one aspect of the present invention a coin selector including horizontal coin conveying means for forcibly conveying a coin inserted through a coin insert slit in the horizontal direction by recirculatively driving an opposing pair of endless belts while the coin is held between the opposing pair of endless belts, wherein the horizontal coin conveying means is slidably arranged in a housing of the coin selector; and the space defined by the opposing pair of endless belts is enlarged by turnably opening the opposing pair of endless belts about their one end.

With the coin selector constructed in the above-described manner, when an inspecting/maintaining operation is performed for the horizontal coin conveying means, the whole horizontal coin conveying means is displaced outside of the housing of the coin selector, and thereafter, the space defined by the opposing pair of endless belts is enlarged by turnably opening the opposing pair of endless belts about their one end. Now, an inspecting/maintaining operations is ready to be performed for respective components constituting the horizontal coin conveying means without any necessity for performing a time-consuming complicated operation such as an operation for disassembling the housing of the coin selector.

To accomplish the secondary object, there is provided according other aspect of the present invention a coin selector including at least horizontal coin conveying means for forcibly conveying a coin inserted through a coin insert slit in the horizontal direction while the coin is held between an opposing pair of endless belts and a cover having the coin insert slit formed thereon, the upstream side of the horizontal coin conveying means being covered with the cover, wherein a hole is formed on the bottom surface of the cover; a liquid collecting portion is arranged downward of the hole so as to allow a liquid to be collected therein and then discharged to the outside therethrough; and the liquid which has been received through the coin insert slit is discharged outside of the housing via the hole and liquid collecting portion.

With the coin selector constructed in the above-described manner, a liquid such as a detergent solution introduced through the coin insert slit is collected in the liquid collecting portion through the hole formed on the bottom surface of the cover with which the upstream side of the horizontal coin conveying means is covered. Thereafter, the liquid in the liquid collecting portion is quickly discharged outside of the housing of the coin selector.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 13 is a sectional view of a conventional coin selector which illustrates that the coin selector is installed in an equipment such as an automatic vending machine or the like;

FIG. 14 is a sectional view which schematically illustrates the structure of a conventional prior art coin selector including horizontal coin conveying means installed in equipment such as an automatic vending machine or the like.

DESCRIPTION OF THE PREFERRED EMBODIMENTS

Now, the present invention will be described in detail hereinafter with reference to the accompanying drawings which illustrate preferred embodiments of the present invention.

Figure 1:
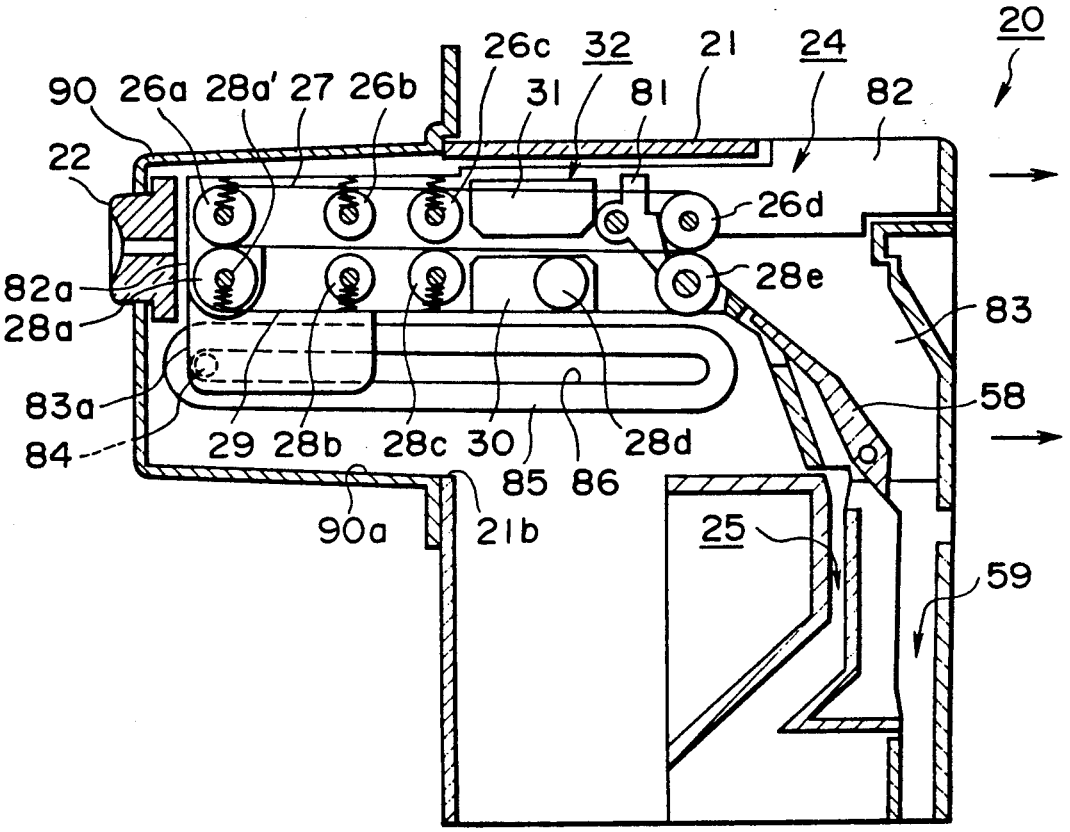
FIG. 1 is a sectional view which schematically illustrates the structure of a coin selector in accordance with an embodiment of the present invention.
Figure 15:
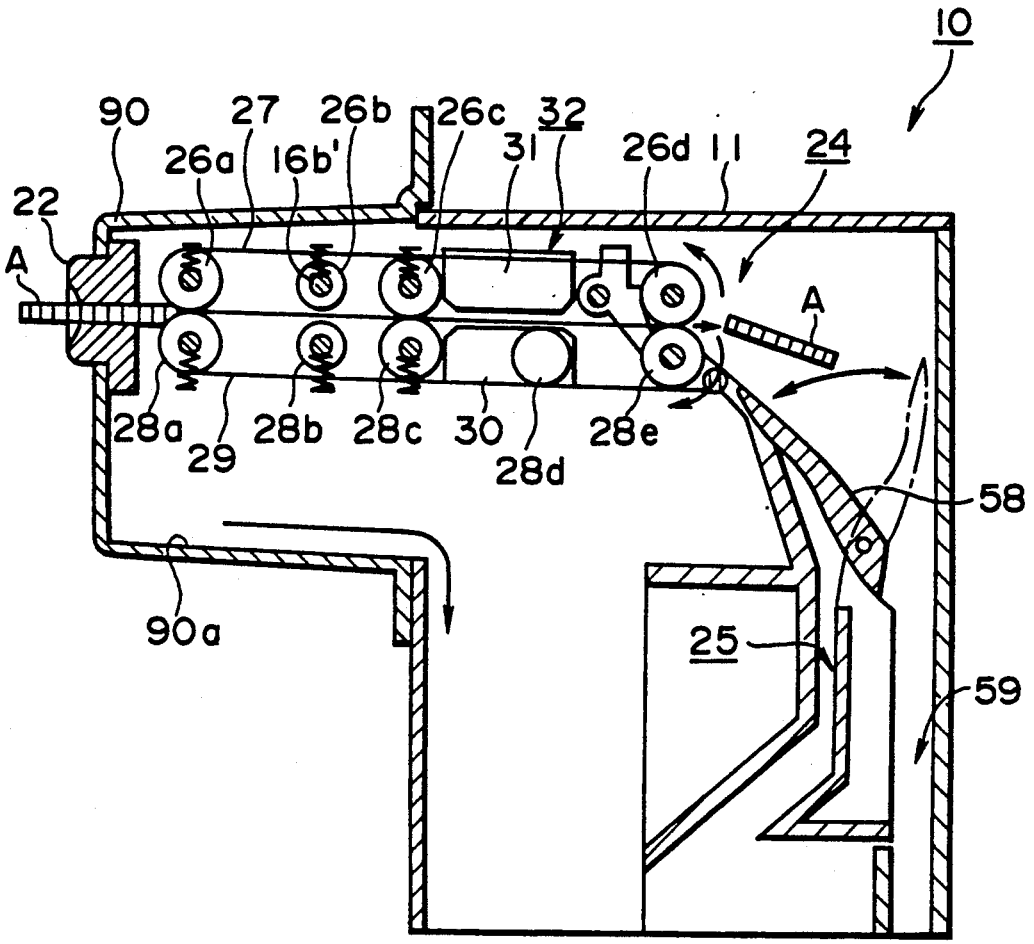
FIG.15 (PRIOR ART)
FIG. 15 is a sectional view of the conventional prior art coin selector in FIG. 14, particularly illustrating a structure of the horizontal coin conveying means.

FIG. 1 is a sectional view of a coin selector 20 including horizontal coin conveying means in accordance with an embodiment of the present invention, and same components to those shown in FIG. 15 are designated by same reference numerals.

The coin selector 20 includes a housing 21 of which left-hand part is covered with a cover 90, and a coin insert slit 22 is received in the cover 90. In addition, the coin selector 20 includes upper and lower support members 82 and 83 both of which are arranged independent of the housing 21. As is apparent from FIG. 1, horizontal coin conveying means 24 is equipped with a group of rollers which are composed of plural opposing pairs of rollers. In detail, shafts for a group of rollers 26*a*, 26*b*, 26*c* and 26*d* arranged on the upper side of the horizontal conveying means 24 are mounted on the upper support member 82, while shafts for a group of rollers 28*a*, 28*b*, 28*c* and 28*e* arranged on the lower side of the same are mounted on the lower support member 83. In addition, the coin selector 20 includes coin discriminating means 32 which are composed of an oscillating coil 30 and a signal receiving coil 31. As shown in FIG. 1, the oscillating coil 30 is mounted on the lower support member 83, while the signal receiving coil 31 is mounted on the upper support member 82. It should be noted that a shaft for the roller 28*d* is mounted on a casing constituting the oscillating coil 30.

A coin distributing lever 58 is arranged on the lower support member 83 in order that among coins each inserted through the coin insert slit 22, false coins are selectively distributed to a false coin chute 59 and true coins are selectively distributed to a single inclined coin rolling-down passage 25 including coin distributing means (not shown).

A foremost end 82*a* of upper support member 82 is turnably supported on the housing 21 to turn about a shaft 28*a*′ disposed at the left-hand end of the lower support member 83 as seen in the drawing, and a guide shaft 84 is disposed at a foremost end 83*a* of the lower support member 83. The guide shaft 84 is engaged with a guide groove 86 on a guide member 85 which is fixedly secured to the housing 21 in the region located downward of the lower support member 83. The guide groove 86 is formed on the guide member 85 while extending in the rightward direction as seen in the drawing.

Figure 2:
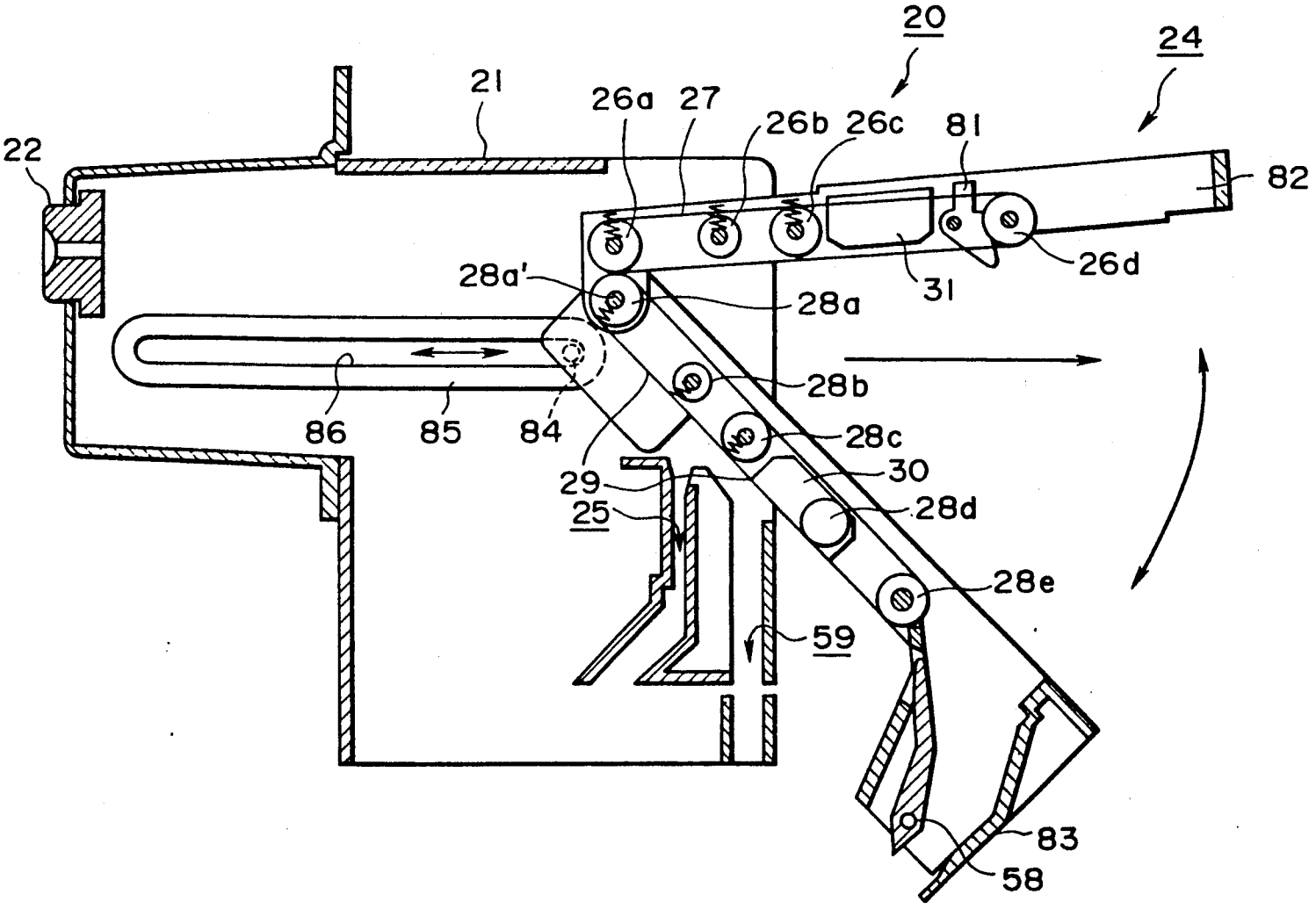
FIG. 2 is an enlarged sectional view of the coin selector in FIG. 1, particularly illustrating the inoperayive state wherein a large part of horizontal coin conveying means is displaced outside of a housing of the coin selector so that it is exposed to the outside.

With the horizontal coin conveying means 24 constructed in the above-described manner, when the upper and lower support members 82 and 83 are displaced in the rightward direction as designated by an arrow mark in FIG. 1, they are slidably displaced along the guide groove 86 on the guide member 85 in the horizontal direction (in the rightward direction), as shown in FIG. 2. As the upper and lower support members 82 and 83 are displaced in that way, a large part of the horizontal coin conveying means 24 is displaced outside of the rear surface of the housing 21 so that it is exposed to the outside. It should be noted that same components in FIG. 2 to those in FIG. 1 are designated by same reference numerals.

Thereafter, as the upper and lower support members 82 and 83 are vertically turnably displaced away from each other in the arrow-marked direction, the lower support member 83 is turned about the shaft 28*a*′ by a predetermined angle, whereby endless belts 27 and 29 constituting the horizontal coin conveying means 24 are parted away from each other.

Since the space between the endless belts 27 and 29 is enlarged while the inoperative state shown in FIG. 2 is maintained, a maintaining/inspecting operation for cleaning and adjusting respective components constituting the horizontal coin conveying means 24, e.g., the endless belts 27 and 29, the respective rollers and the coin discriminating means 32 can very easily be performed by inserting a certain jig such as a wood rod covered with cotton fibers into the foregoing space.

When the horizontal coin conveying means 24 is to be restored in position in the housing 21 again after completion of the maintaining/inspecting operation, it should of course be noted that operations reverse to the foregoing ones are performed. In FIG. 1, reference numeral 81 designates a coin pulling-back preventive lever for preventing each coin inserted through the coin insert slit 22 from being pulled back by actuating a fishing thread with user's fingers.

Figure 3:
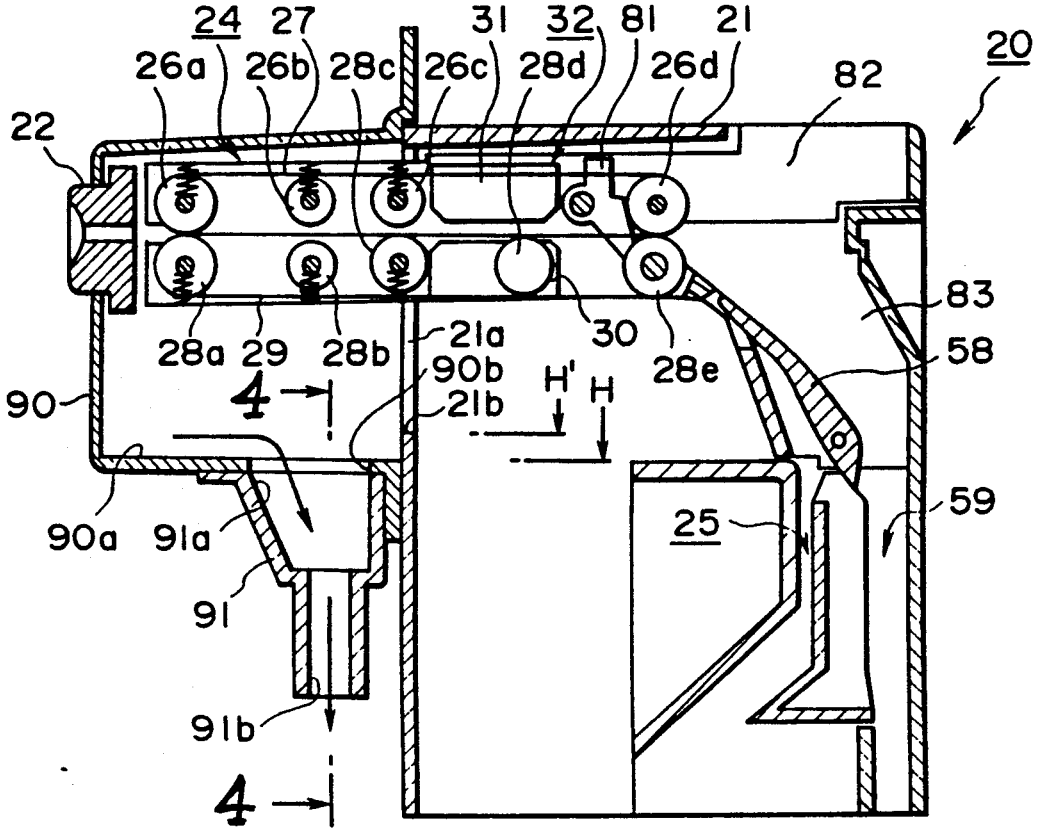
FIG. 3 is a sectional view of the coin selector similar to FIG. 1, particularly illustrating that a liquid collecting portion is attached to the bottom surface of the coin selector.

As shown in FIG. 3 in which same components to those in FIG. 1 are designated by same reference numeral, a liquid collecting portion 91 is attached to the bottom 90*a* of the cover 90 so as to collect a liquid flowing onto the bottom 90*a* of the cover 90 and then discharge it to the outside in order to assure that the liquid received through the coin insert slit 22 is not introduced into the housing 21.

Referring to FIG. 3, the cover 90 is designed such that a height H′ of the cover 90 as measured on the rear side is dimensioned to be larger than a height H′ of an opening 21*a* of the housing 21 through which the horizontal coin conveying means 24 is received in the housing 21. As is apparent from the drawing, when the upstream side of the horizontal coin conveying means 24 is covered with the cover 90, the bottom 90*a* of the cover 90 is located downward of a lower edge 21*b* of the opening 21*a* with the result that the lower edge 21*b* of the opening 21*a* extending in the transverse direction of the cover 90 exhibits a function as a weir for preventing the received liquid from flowing over the lower edge 21*b* of the opening 21*a*.

Figure 4:
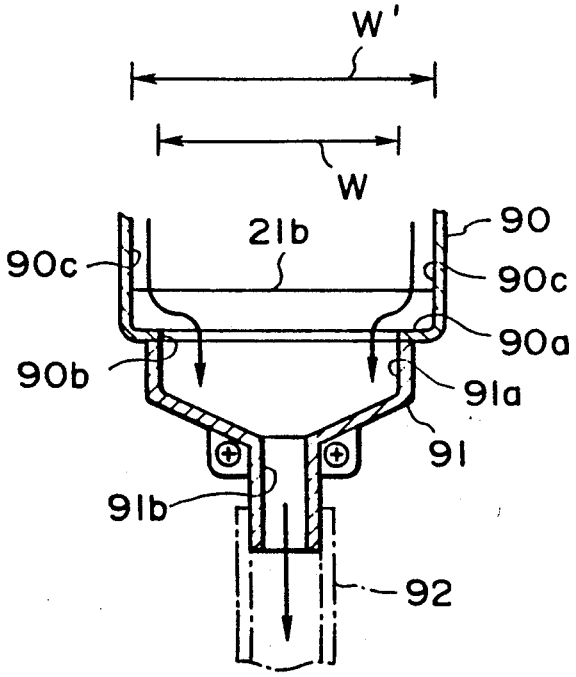
FIG. 4 is a sectional view of the liquid collecting portion taken along line 4—4 in FIG. 3.

A hole 90*b* is formed through the bottom 90*a* of the cover 90. As shown in FIG. 4, i.e., a sectional view of the cover 90 taken along line 4—4 in FIG. 3, a width W of the hole 90*b* is dimensioned to be slightly smaller than a width W' of the cover 90. Alternatively, the width W of the hole 90*b* may be dimensioned to be equal to the width W' of the cover 90 or more than the same.

As shown in FIG. 4, the liquid collecting portion 91 having a funnel-shaped sectional contour is arranged downward of the hole 90*b*.

The liquid collecting portion 91 is communicated with the hole 90*b* and includes an opening portion 91*a* which fully surrounds the periphery of the hole 90*b*. In addition, a discharge hole 91*b* is formed through the liquid collecting portion 91 so as to allow the liquid collected in the liquid collecting portion 91 to be discharged to the outside of the housing 21 in the arrow-marked direction as seen in the drawing.

Next, description will be made below with respect to a function of the liquid collecting portion 91.

With the coin selector 20 shown in FIG. 3, since the upstream side of the horizontal coin conveying means 24 is covered with the cover 90 having the coin insert slit 22 received therein, the hole 90*b* is formed through the bottom 90*a* of the cover 90, and moreover, the liquid collecting portion 91 communicated with the hole 90*b* is arranged downward of the hole 90*b*, water drops derived from rain fall or a liquid such as a detergent solution flow to the housing 21 side along the bottom 90*a* of the cover 90 (as illustrated by an arrow mark). Then, the liquid is collected in the funnel-shaped liquid collecting portion 91 via the hole 90*b*, and thereafter, the liquid is quickly discharged outside of the housing 21 through the discharge hole 91*b* which is formed downward of the liquid collecting portion 91.

In addition, water drops derived from the rain fall or a liquid such as a detergent solution flowing along side surfaces 90*c* of the cover 90 through the coin insert slit 22 in the arrow-marked direction as seen in FIG. 4 are likewise collected in the liquid collecting portion 91 through the hole 90*b*, and thereafter, the liquid is quickly discharged outside of the housing 21 through the discharge hole 91*b* which is formed downward of the liquid collecting portion 91.

As illustrated by one-dot chain lines in FIG. 4, it is recommendable that a liquid guide member 92 such as a rubber tube or the like is fitted onto the discharge hole 91*b* of the liquid collecting portion 91 and a part of the liquid guide member 92 is exposed to the outside outward of an equipment such as an automatic vending machine or the like so as to enable the liquid flowing in the interior of the coin selector 20 through the coin insert slit 22 to be quickly discharged to the outside therethrough.

As is apparent from FIG. 3 and FIG. 4, the lower edge 21*b* of the opening 21*a* (see FIG. 3) having a function of serving as a weir is intended to prevent the overflowed liquid from flowing in the interior of the housing 21 as far as possible when a large quantity of liquid flows in the interior of the housing 21 through the coin insert slit 22. However, the lower edge 21*b* of the opening 21*a* is not always required. Alternatively, as shown in FIG. 1, the bottom 90*a* the cover 90 may be flush with the lower edge 21*b* of the opening 21*a*.

According to the aforementioned embodiment of the present invention, the liquid collecting portion 91 having a funnel-shaped sectional contour is arranged independent of the cover 90. However, the present invention should not be limited only to this embodiment. The liquid collecting portion 91 may be made integral with the cover 90.

With the coin selector 20 including the horizontal coin conveying means 24 as described above, there is a possibility that when the horizontal coin conveying means 24 is restored in the housing 21 again after a maintaining/inspecting operation is performed for the horizontal coin conveying means 24 while a large part of the horizontal coin conveying means 24 is displaced outside of the housing 21, there arises a malfunction that the horizontal coin conveying means 24 is undesirably clogged with coins A inserted through the coin insert slit 22 unless the horizontal coin conveying means 24 is restored at a normal position in the housing 21.

To prevent an occurrence of the malfunction of coin clogging because of undesirable failure of the horizontal coin conveying means 24 to be restored at the normal position in the housing 21, it is recommendable that the following arrangement is employed for the coin selector 20 of the present invention.

Figure 5:
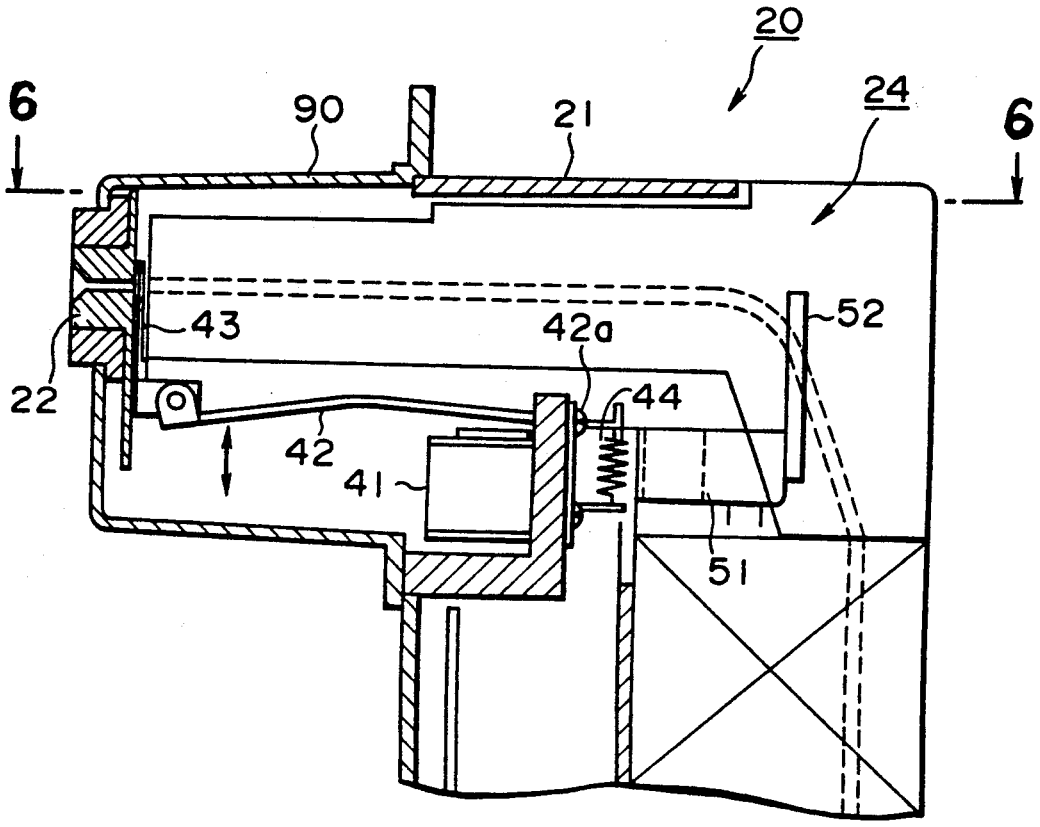
FIG. 5 is a sectional view of the coin selector in FIG. 1, particularly illustrating that a shutter is interposed between a coin insert slit and the foremost end of the horizontal coin conveying means.

FIG. 5 is a fragmentary sectional view which schematically illustrates the structure of a coin selector 20 for which arrangement for preventing an occurrence of the malfunction of coin clogging because of undesirable failure of the horizontal coin conveying means 24 to be restored at a normal position in the housing 21 is employed. Components each exhibiting a same function as those in FIG. 1 are designated by same reference numerals for the purpose of convenience of description.

In detail, a shutter 43 is interposed between the coin insert slit 22 and the foremost end of the horizontal coin conveying means 24 while it is operatively connected to an arm 42 for displacing the shutter 43 away from the shown position. The arm 42 is turnably supported to turn about a support point 42*a*, and the rear end of the arm 42 is normally pulled by a spring 44. In addition, a shutter solenoid 41 is arranged in the proximity of the arm 42. Since the rear end of the arm 42 is upwardly pulled by the spring 44 while the shutter solenoid 41 is not activated, the arm 42 is turned to the shown position so that the coin insert slit 22 is closed with the shutter 43.

When the shutter solenoid 41 is activated while the foregoing state is maintained, the arm 42 is attractively displaced away from the coin insert slit 22 by the shutter solenoid 41 against the resilient force of the spring 44, whereby the coin insert slit 22 is opened because the shutter 43 has been displaced away from the coin insert slit 22.

A set switch 51 is installed in the housing 21 so as to detect whether the horizontal coin conveying means 24 is restored at a normal position in the housing 21 or not. In addition, an actuator 52 is mounted on the horizontal coin conveying means 24 so as to drive the set switch 51 when the horizontal coin conveying means 24 is restored at the normal position in the housing 21. In a case where the horizontal coin conveying means 24 is restored at a position offset from the normal position in the housing 21, the set switch 51 is shifted to OFF. On the contrary, in a case where the horizontal coin conveying means 24 is restored at the normal position in the housing 21, the actuator 52 mounted on the horizontal coin conveying means 24 comes in contact with the set switch 51, whereby the set switch 51 is shifted to ON.

Next, operations of the actuator 52 and the set switch 51 will be described in more detail with reference to FIG. 6 and FIG. 7 both of which are sectional views taken along line 6—6 in FIG. 5, respectively.

Figure 6:
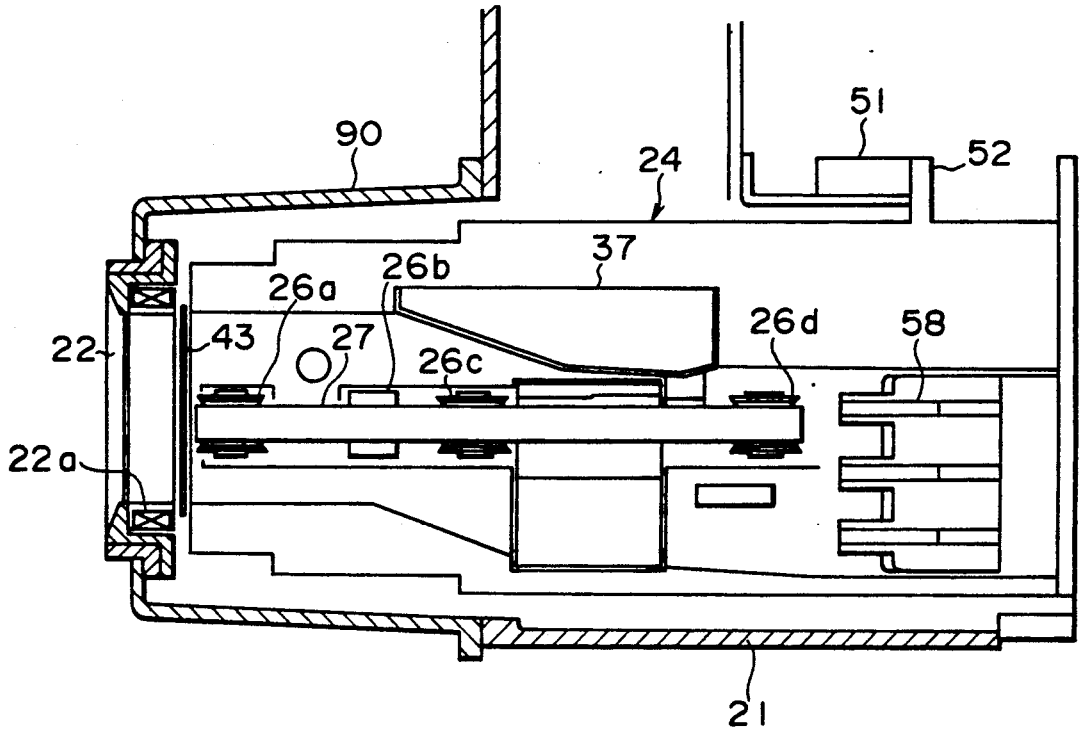
FIG. 6 is a sectional view of the coin selector taken along line 6—6 in FIG. 5.
Figure 7:
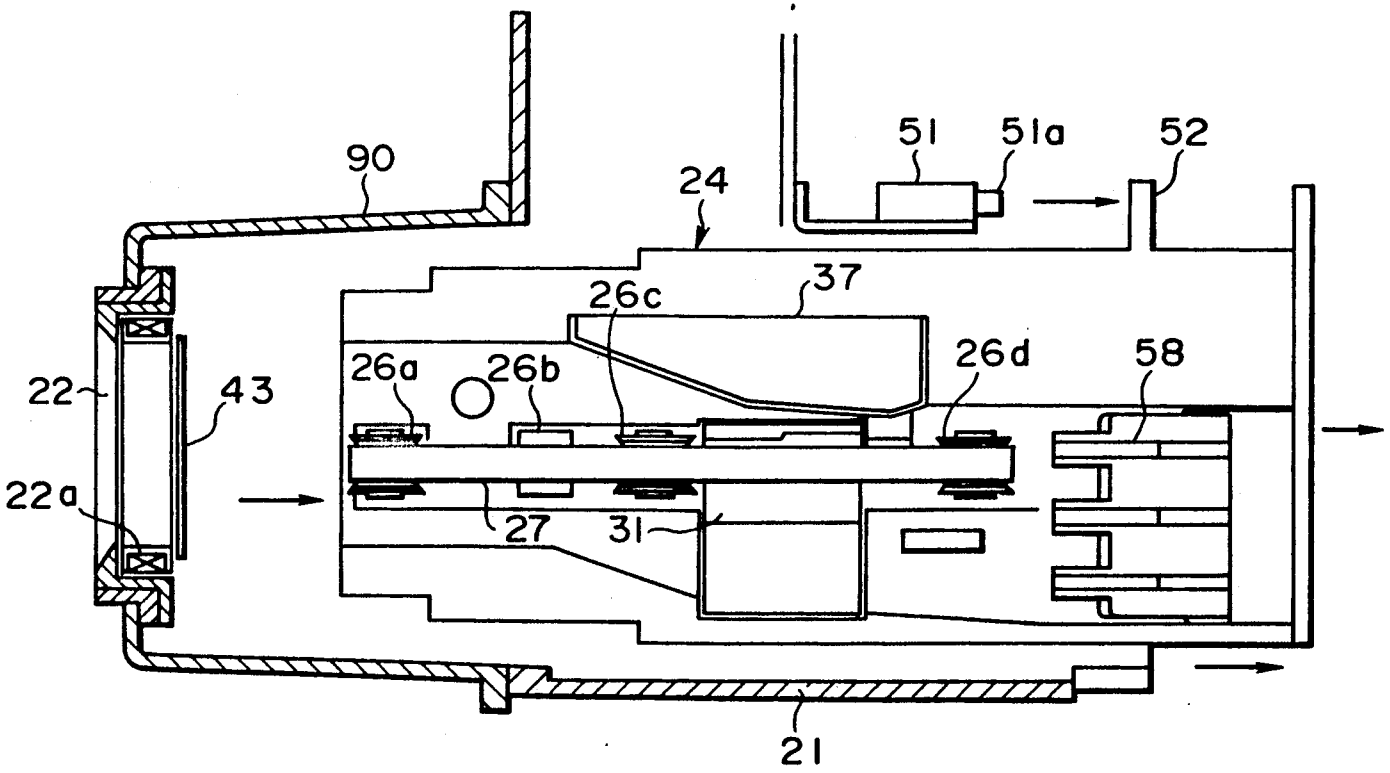
FIG. 7 is another sectional view of the coin selector taken along line 6—6 in FIG. 5.

When the horizontal coin conveying means 24 is outwardly displaced from the position where it is restored at the normal position in the housing 21 as shown in FIG. 6 to the position where it is restored at another position offset from the normal position as shown in FIG. 7, the actuator 52 which has been brought in contact with the set switch 51 is parted away from the set switch 51, whereby an actuation projection 51*a* of the set switch 51 is projected from the set switch 51 so that the set switch 51 is shifted to OFF.

Subsequently, when the horizontal coin conveying means 24 is squeezed into the housing 21 in the opposite direction to the arrow-marked direction in FIG. 7 and then it reaches the normal position in the housing 21 as shown in FIG. 6 so that it is restored at the normal position in the housing 21, the actuator 52 mounted on the horizontal coin conveying means 24 comes in contact with the set switch 51. This causes the actuation projection 51*a* of the set switch 51 (see FIG. 7) to be retracted, whereby the set switch 51 is shifted to ON.

In FIG. 6 and FIG. 7, reference numeral 37 designates a guide plate for properly guiding conveyance of each coin through the horizontal coin conveying means 24. In addition, reference numeral 22*a* designates an inlet coil sensor. The inlet coil sensor 22*a* detects whether a coin is inserted through the coin insert slit 22 or not.

Figure 8:
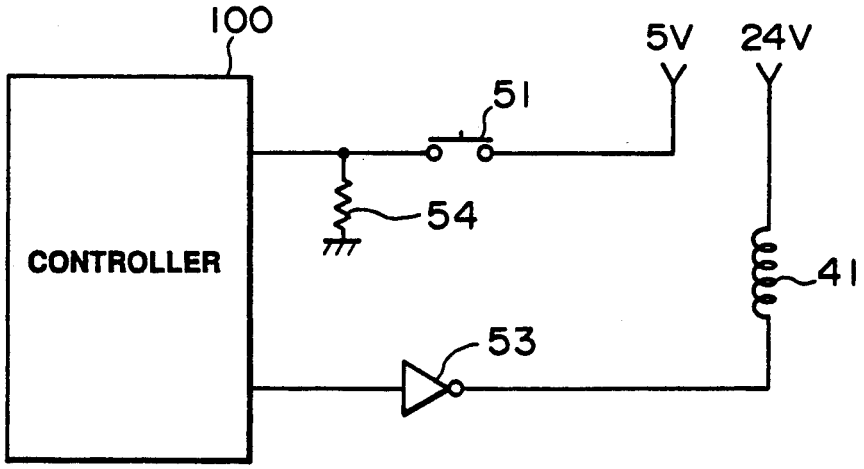
FIG. 8 is a circuit diagram which illustrates by way of example a control circuit for the coin selector of the present invention.

FIG. 8 is a circuit diagram which illustrates by way of example a control circuit for carrying out coin receiving processing for the coin selector 20. It should be noted that the set switch 51 and the shutter solenoid 41 are shown in FIG. 8 but illustration of other components in respect of their control is eliminated for the purpose of simplification.

Referring to FIG. 8, when the set switch 51 is shifted to OFF, a signal having a low level, i.e., an earthed level is applied to a controller 100 in the presence of a resistor 54 as a signal representing that the set switch 51 has been shifted to OFF. In addition, when the set switch 51 is shifted to ON, a signal having a high level of 5 V is applied to the controller 100 as a signal representing that the set switch 51 has been shifted to ON.

Additionally, a driving signal is applied to the shutter solenoid 41 from the controller 100 via an inverter 53. This causes the shutter solenoid 41 to be driven with an electricity of 24 V.

Next, operation of the controller 100 will be described below particularly with respect to coin receiving processing with reference to a flowchart shown in FIG. 9.

Figure 9:
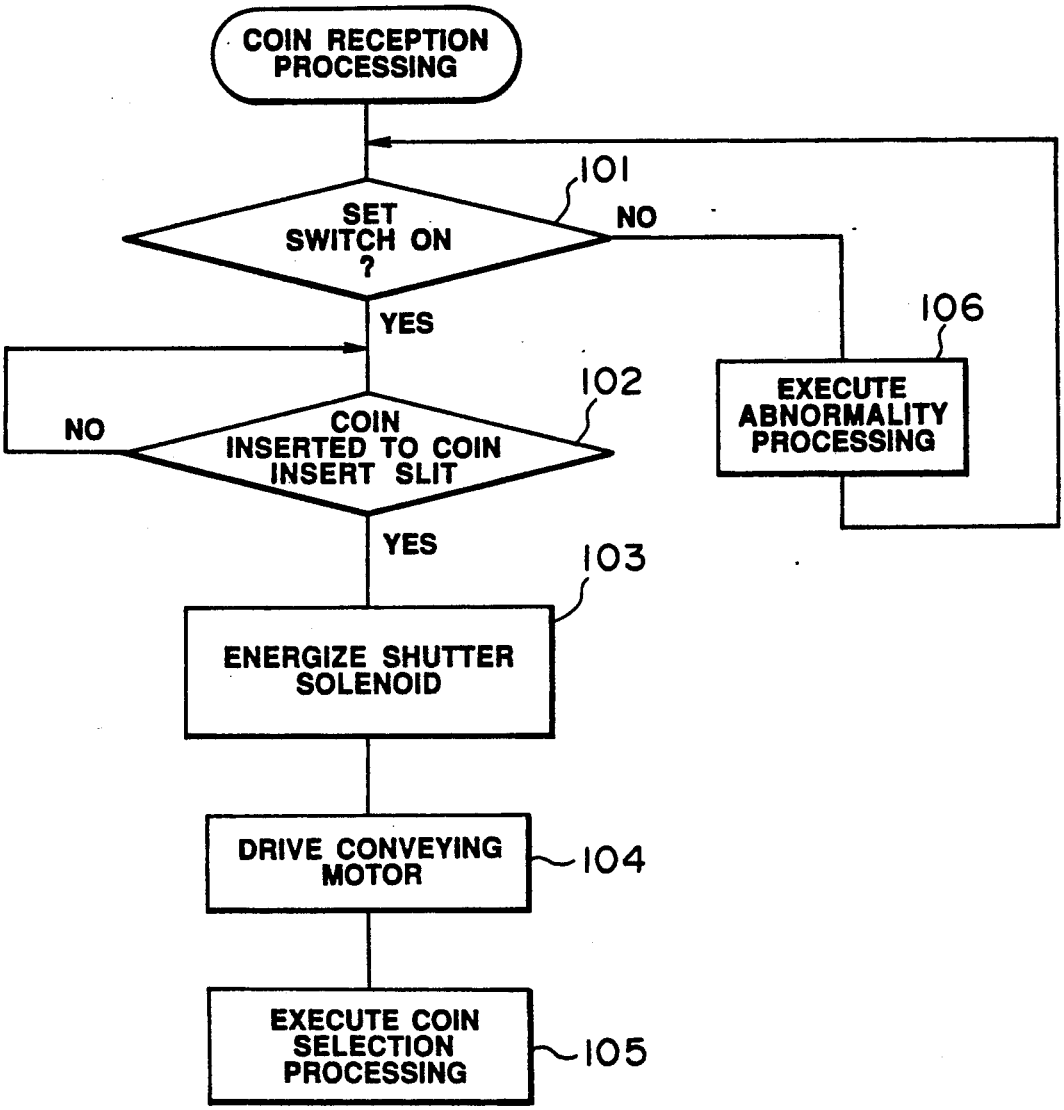
FIG. 9 is a flowchart which illustrate operation of the control circuit shown in FIG. 8.

Referring to FIG. 9, first, the controller 100 examines whether the set switch 51 is shifted to ON or not (step 101). At the step 101, the controller 100 can discriminate in response to a signal transmitted from the set switch 51 that the set switch 51 is shifted to ON or not. If the set switch 51 is not shifted to ON, this means that the horizontal coin conveying means 24 is not restored at a normal position in the housing 21 of the coin selector 20. Then, the controller 100 executes predetermined abnormality processing by activating an alarm or the like (step 106).

When the controller 100 determines at the step 101 that the set switch 51 is shifted to ON, the controller 100 examines whether a coin is inserted through the coin insert slit 22 or not (step 102). The controller 100 can determine the result derived from the examination at the step 102 based on an output from the inlet coil sensor 22*a* as shown in FIG. 6 and FIG. 7.

When the controller 100 determines at the step 102 that a coin has been inserted through the coin insert slit 22, the controller 100 generates a driving signal for driving the shutter solenoid 41, whereby the shutter solenoid 41 is activated (step 103). On activation of the shutter solenoid 41, the shutter 43 is displaced away from the coin insert slit 22, causing the shutter 22 to be opened. Subsequently, the controller 100 drives a conveying motor (not shown) for driving the horizontal coin conveying means 24 (step 104). Then, the coin which has been inserted through the coin insert slit 22 is introduced into the horizontal coin conveying means 24 so that the coin is subjected to predetermined coin selecting processing (step 105).

With the coin selector 20 constructed in the above-described described manner, since the controller 100 makes it possible to drive the shutter solenoid 41 under a condition that the set switch 51 is shifted to ON, any coin is not introduced into the horizontal coin conveying means 24 by any means as long as the horizontal coin conveying means 24 is not restored at the normal position in the housing 21.

Figure 10:
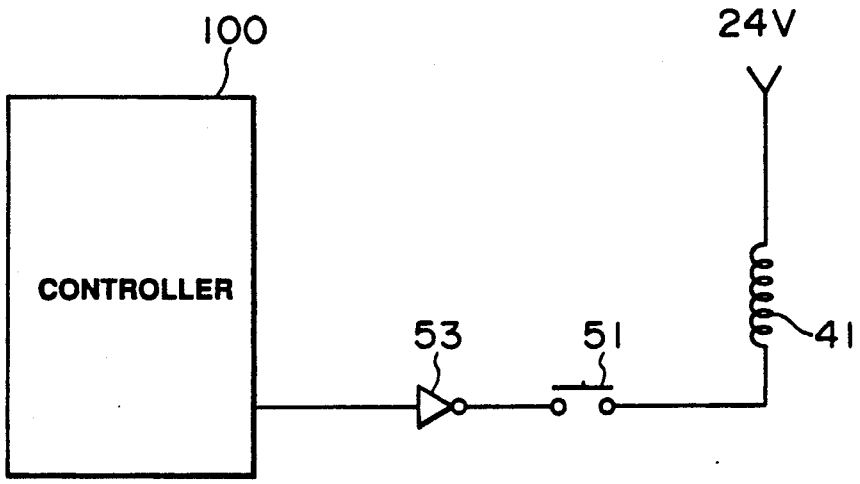
FIG. 10 is a circuit diagram which illustrates a control circuit for the coin selector in accordance with another embodiment of the present invention.

According to the aforementioned embodiment of the present invention, the coin selector 20 is constructed such that an output from the set switch 51 is inputted into the controller 100 as it is. However, the present invention should not be limited only to this embodiment. Alternatively, the set switch 51 may be interposed between the inverter 53 and the shutter solenoid 41, as shown in FIG. 10. In this case, when the controller 100 carries out coin receiving treatment, the step 101 in the flowchart shown in FIG. 9 can be eliminated. Also with this construction, the controller 100 does not make it possible to drive the shutter solenoid 41 as long as the horizontal coin conveying means 24 is not restored at the normal position in the housing 21 of the coin selector 20 and the set switch 51 is not shifted to ON.

Since the coin selector 20 is constructed such that the horizontal coin conveying means 24 is slidably arranged in the housing 21, and moreover, the shutter 41 is not opened by any means as long as the horizontal coin conveying means 24 is restored at the normal position in the housing 21, the coin selector 20 can reliably prevent a malfunction of coin clogging from occurring due to undesirable failure of the horizontal coin conveying means 24 to be restored at the normal position in the housing 21.

The coin selector 20 of the present invention is practically installed in an equipment such as an automatic vending machine, a coin exchanger, a monetary service unit or the like to serve as a coin selecting section in a so-called coin treatment equipment in which coins inserted through the coin insert slit 22 are selectively received and stored depending on the kind of coins and some of the received coins are paid out as a change. To facilitate complete understanding of the coin treatment apparatus in which the coin selector 20 of the present invention is installed, a typical example of the coin treatment apparatus having the coin selector 20 installed therein will be described below with reference to FIG. 11 and FIG. 12.

Figure 11:
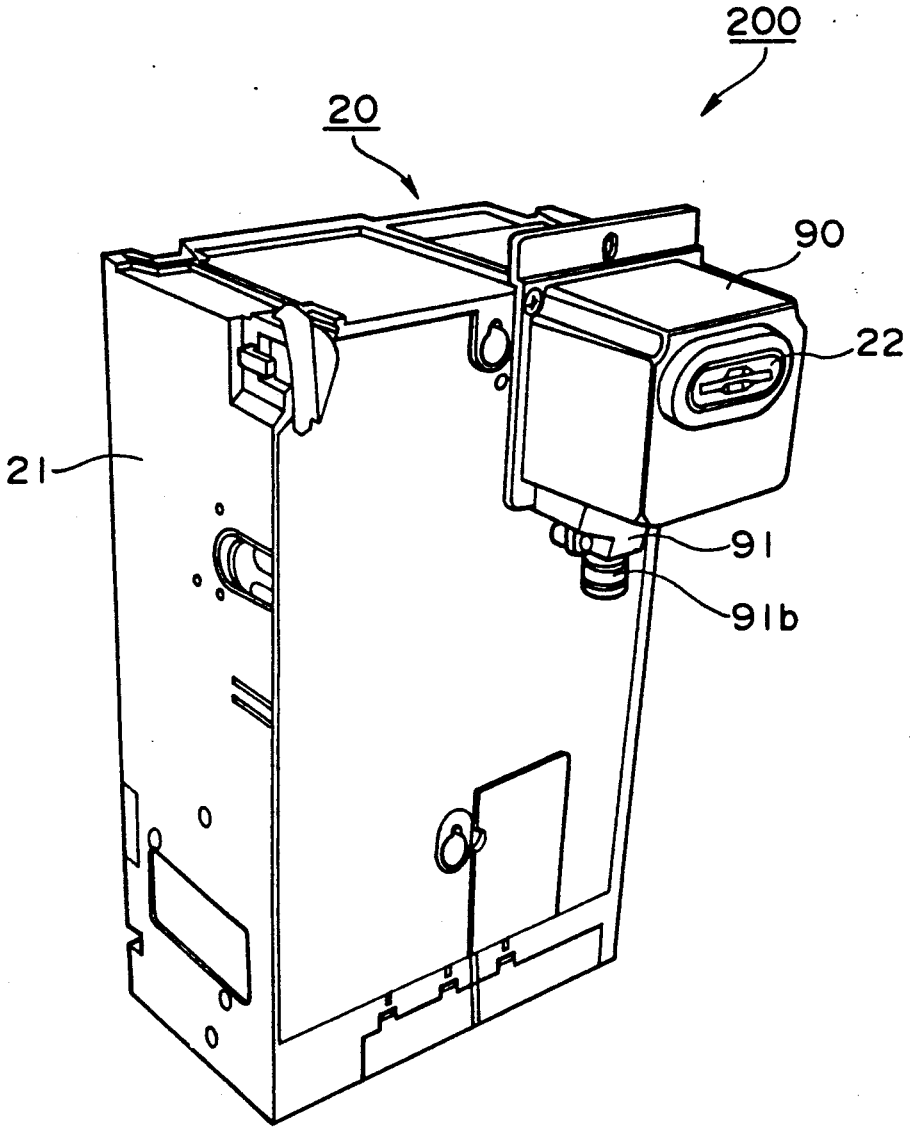
FIG. 11 is a perspective view of a coin treatment apparatus in which the coin selector of the present invention is installed, particularly illustrating a configuration of the apparatus as seen from the front side.
Figure 12:
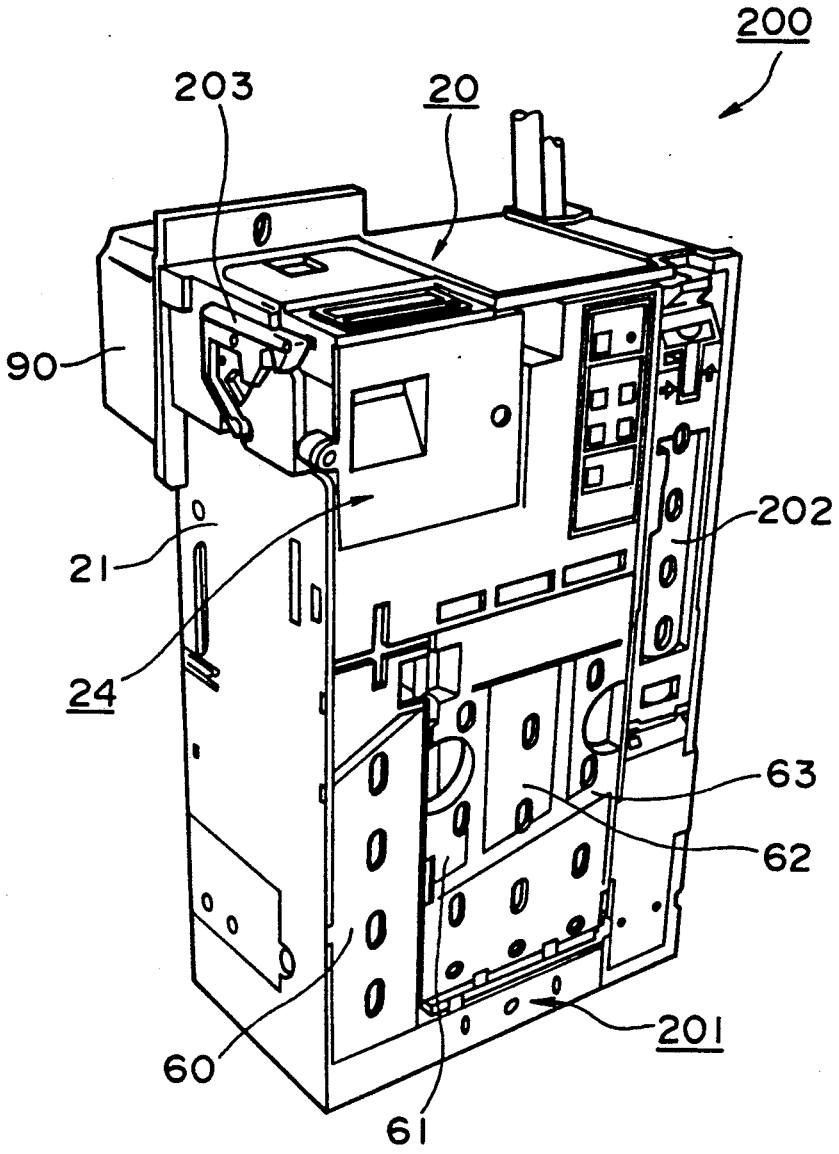
FIG. 12 is a perspective view of the coin treatment apparatus in FIG. 11, particularly illustrating the configuration of the apparatus as seen from the rear side.
Figure 13:
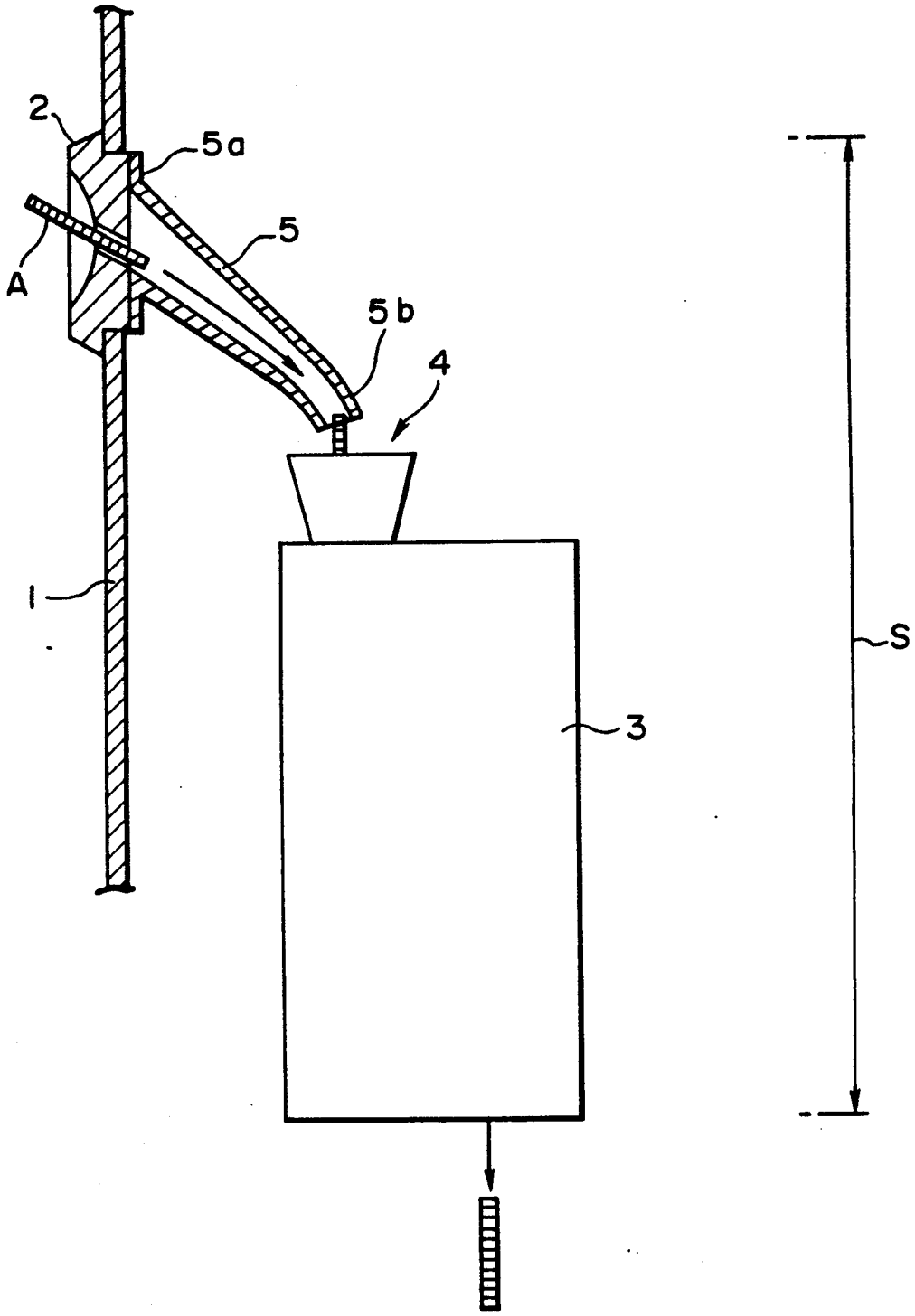
FIG.13 (PRIOR ART)
Figure 14:
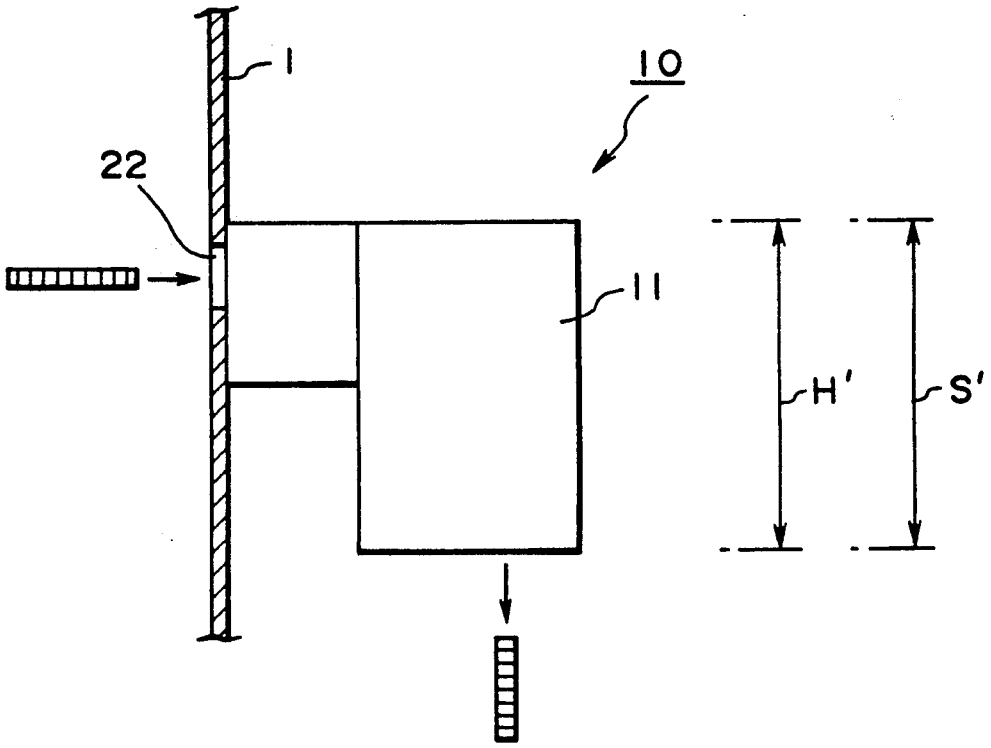
FIG. 14 (PRIOR ART)

FIG. 11 is a perspective view of a coin treatment apparatus 200 including the coin selector 20 of the present invention, particularly illustrating a configuration of the apparatus as seen from the front side, and FIG. 12 is another perspective view of the apparatus 200, schematically illustrating the configuration of the apparatus 200 as seen from the rear side, wherein same components to those shown in FIG. 1 to FIG. 7 are designated by same reference numerals.

As is apparent from FIG. 11 and FIG. 12, the coin treatment apparatus 200 is constructed integral with the housing 21 of the coin selector 20. The whole configuration and dimensions of the coin treatment apparatus 200 are determined to be amazingly compact in comparison with a conventional coin treatment apparatus including the conventional coin selector.

Specifically, as shown in FIG. 12, an upper part of the coin treatment apparatus 200 is equipped with the coin selector 20 of the present invention, and a plurality of coin tubes 60, 61, 62 and 63 are arranged at the lower part of the apparatus 200 so as to receive and store therein coins selected depending on the kind of coins. In addition, a coin paying-out unit 201 including a conventional paying-out slider and others is arranged downward of the respective coin tubes 60, 61, 62 and 63 in order to pay out some of coins received and stored in the coin tubes 60, 61, 62 and 63 so as to meet a requirement for a change.

In FIG. 12, reference numeral 202 designates an auxiliary coin tube for especially receiving coins of the kind repeatedly used with a high frequency, and reference numeral 203 designates a latch for firmly holding the slidably restored horizontal coin conveying means 24 in the housing 21 of the coin selector 20 in a locked state.

While the present invention has been described above with respect to a few preferred embodiments thereof, it should of course be understood that the present invention may be carried out in any acceptable manner without departure from the spirit and purport of the invention. Therefore, the aforementioned embodiments are merely illustrative in all respects, and it should be construed that these embodiments are not limitative. In addition, the scope of the present invention should be defined by the appended claims but they should not be restricted by description of the specification at all. Additionally, it should be construed that all changes or modifications remaining within the scope of the present invention fall under the scope of the invention as defined by the appended claims.

What is claimed is:

1. A coin selector comprising horizontal coin conveying means including an opposing pair of endless belts having a portion closely located to a coin insert slit of the coin selector for forcibly conveying a coin inserted through the coin insert slit in the horizontal direction by driving said opposing pair of endless belts while said coin is held between said opposing pair of endless belts, said horizontal coin conveying means being slidably arranged in a housing of the coin selector such that the belts of the horizontal coin conveying means may be pulled outside of the housing while remaining connected thereto, and the space defined between said endless belts then being enlarged by pivotably opening said opposing pair of endless belts with said portion of the endless belts serving as a pivot point.

2. The coin selector as claimed in claim 1, wherein said horizontal coin conveying means is arranged independent of said housing, and, said horizontal coin conveying means is supported by upper and lower support members which are slidably arranged in said housing.

3. The coin selector as claimed in claim 2, wherein said upper support member and said lower support member are openably arranged to turn about one end thereof, a group of rollers composed of plural opposing pairs of rollers are rotatably supported on said upper support member and said lower support member, and one of said opposing pair of endless belts extends around a group of rollers among said plural opposing pairs of rollers rotatably supported on said upper support member, while another one of said opposing pair of endless belts extends around a group of rollers among said plural opposing pairs of rollers rotatably supported on said lower support member.

4. The coin selector as claimed in claim 1, wherein coin discriminating means including an oscillating coil and a signal receiving coil with a predetermined gap therebetween is located intermediate opposite ends of said horizontal coin conveying means.

5. A coin selector comprising horizontal coin conveying means including an opposing pair of endless belts each having opposite first and second ends, said endless belts defining therebetween a generally horizontal coin conveying path along which coins are conveyed from said first ends toward said second ends, coin insert means adjacent said first ends, first and second support members for supporting respective first and second of said pair of endless belts, means mounting said support members for reciprocal sliding movement generally in the direction of the coin conveying path, and means for relatively pivotally connecting said first and second support member to effect relative pivoting opening and closing movement therebetween between respective open and closed positions.

6. The coin selector as defined in claim 5 wherein said first and second support members each have respective first and second ends generally adjacent said respective first and second belt ends, and said pivotally connecting means pivotally connect said first and second support member first ends relative to each other.

7. The coin selector as defined in claim 5 wherein said first and second support members each have respective first and second ends generally adjacent said respective first and second belt ends, and said reciprocal mounting means mount said second support member first end for reciprocal sliding movement.

8. The coin selector as defined in claim 5 wherein said first and second support members each have respective first and second ends generally adjacent said respective first and second belt ends, and said pivotally connecting means pivotally connect said second support member for pivoting movement about an axis adjacent its first end.

9. The coin selector as defined in claim 6 wherein said reciprocal mounting means mount said second support member first end for reciprocal sliding movement.

10. The coin selector as defined in claim 6 wherein said first support member is generally disposed above and parallel to said second support member in said closed position, and said belt first ends and said first and second support member first ends are disposed adjacent said coin insert means in the closed position of said support members.

11. The coin selector as defined in claim 7 wherein said first support member is generally disposed above and parallel to said second support member in said closed position, and said belt first ends and said first and second support member first ends are disposed adjacent said coin insert means in the closed position of said support members.

12. The coin selector as defined in claim 8 wherein said first support member is generally disposed above and parallel to said second support member in said closed position, and said belt first ends and said first and second support member first ends are disposed adjacent said coin insert means in the closed position of said support members.

13. The coin selector as defined in claim 9 wherein said first support member is generally disposed above and parallel to said second support member in said closed position, and said belt first ends and said first and second support member first ends are disposed adjacent said coin insert means in the closed position of said support members.

* * * * *